United States Patent [19]

Mitchell

[11] 4,322,069

[45] Mar. 30, 1982

[54] SHEET SORTING APPARATUS

[75] Inventor: Charles S. Mitchell, Portola Valley, Calif.

[73] Assignee: Konishiroku Photo Industry Co., Ltd., Tokyo, Japan

[21] Appl. No.: 90,511

[22] Filed: Nov. 2, 1979

[51] Int. Cl.[3] ..... B65H 39/11; B65H 29/12

[52] U.S. Cl. ..... 271/296; 271/292; 271/302; 271/200; 355/3 SH

[58] Field of Search ..... 271/296, 292, 293, 294, 271/287, 297, 302, 198, 200, 201, 272–274, 188; 198/812, 840, 842, 806, 835; 355/3 SH, 14 SH; 187/94

[56] References Cited

U.S. PATENT DOCUMENTS

| | | | |
|---|---|---|---|
| 359,437 | 3/1887 | Foster | 187/94 X |
| 815,008 | 3/1906 | Davidson | 271/302 X |
| 2,593,157 | 4/1952 | Lorig | 198/840 X |
| 2,649,182 | 8/1953 | Parker | 271/296 X |
| 3,315,957 | 4/1967 | Mazzio et al. | 271/296 |
| 3,356,362 | 12/1967 | Mestre | 271/296 X |
| 3,950,090 | 4/1976 | Washio et al. | 355/8 |
| 3,988,018 | 10/1976 | Tusso et al. | 271/297 X |

*Primary Examiner*—Bruce H. Stoner, Jr.

*Attorney, Agent, or Firm*—Bierman & Bierman

[57] ABSTRACT

A sheet sorting apparatus for use in combination with an electrophotographic copying machine includes introducing rollers, discharge rollers, and a pair of transporting belts disposed in superposed relation in a tensioned state for feeding copy sheets in sandwiched relation therebetween from the introducing to the discharge rollers. The discharge rollers are carried on a vertically movable platform so that the transported sheets are dischargeable to a selected one of a plurality of receiving trays, movement of the platform effecting variation in the distance between the introducing and discharge rollers. Structure is provided for maintaining the tensioned state of the belts as said distance varies.

16 Claims, 13 Drawing Figures

SHEET SORTING APPARATUS

BACKGROUND OF THE INVENTION

1. Field of the Invention

The present invention relates in general to an apparatus for sorting sheets being supplied thereto and in particular concerns a sheet sorting apparatus which is adapted to collect copied sheets from a copying machine in proper order of page sequence.

2. Description of the Prior Art

The sheet sorting apparatus which have been heretofore employed in business machines or pattern (or image) recording apparatus such as copying machines, printers or the like and often referred to as sorters may generally be classified into two types. One type of sheet sorting apparatus comprises a movable bin assembly constituted by a plurality of vertically aligned sheet receiving trays and a stationary sheet transporting path provided by sheet discharging and transporting means arranged stationarily between a sheet discharging exit of a recording apparatus and the bin assembly. The second type of sheet sorting apparatus includes a plurality of bins arranged at a fixed position and adapted to receive the sheets discharged from the recording apparatus, and transporting means provided at the discharge side of the recording apparatus for distributing sequentially the sheets as discharged into the plurality of bins, wherein the transporting means is movably arranged so as to effect the transportation and distribution of the sheets. The present invention is intended as an improvement in the second type of sheet sorting apparatus. A typical structure of the second type of sheet sorting apparatus is disclosed in U.S. Pat. No. 3,356,362. This prior art sheet sorting apparatus or so-called sheet sorter includes as many as fifty pockets for receiving the incoming sheets and is implemented in an extremely large size having a height on the order of six or more feet. A conveyor system as employed for transporting the sheets is constituted by a number of belts arrayed in a row, involving complications in the structure which must necessarily be provided with weights for maintaining the transporting belts in a tensioned state and to accommodate possible variations in the length of the transporting path. The sorter of such structure is obviously not suited for use in combination with an electrophotographic copying apparatus.

SUMMARY OF THE INVENTION

Accordingly, a primary object of the invention is to provide an improved sheet sorting apparatus in which a bin assembly comprising a plurality of sheet receiving members is held stationary, while sheets discharged from a business machine or pattern (image) recording machine such as a copying machine, printer or the like are successively transported in a sandwiched state between a pair of endless belts and in which an exit port of the sorting apparatus is adapted to be moved in a substantially vertical direction (up- and down-directions), as occasion requires, thereby to distribute the sheets sequentially onto the associated receiving trays (hereinafter referred to as the bins). The transporting belts constituting the transporting means are of a sufficient length to span a maximum distance between sheet introducing means provided at a fixed position and discharging means which is movable relative to the sheet introducing means, so that the transporting belts are disposed in a sagged state when the above distance becomes minimum.

Another object of the invention is to provide a sheet sorting apparatus which is capable of being removably mounted on a main body of an image or pattern recording apparatus such as a copying apparatus in a facilitated manner.

In view of the above and other objects which will become more apparent as the description proceeds, there is proposed according to a general aspect of the invention a structure of sheet sorting apparatus in which the sheets as discharged from a pattern or image recording apparatus are received by sheet introducing roller means and, after having been transported through transporting means, are distributed successively into a plurality of bins. These bins have respective openings arrayed in a moving direction of the discharge roller means which is mounted on a movable base and which is movable in a substantially vertical direction, wherein transporting means arranged between the sheet introducing roller means and the discharge roller means is constituted by a pair of vertically arrayed endless belts suspended around the sheet introducing roller means and the sheet discharge roller means. The belts have a sufficient length to span a maximum possible distance between the sheet introducing roller means and the sheet discharge roller means, the maximum distance occurring upon displacement of the discharge roller means to its furthest position from the sheet introducing roller means. In this connection, the range through which the sheet discharge roller means is allowed to be moved should preferably extend above and below the position or level of the sheet introducing roller means in order to reduce differences in the length of the transporting path extending between the sheet introducing roller means and the discharge roller means upon movement of the latter.

In a preferred embodiment of the invention described hereinafter in conjunction with the accompanying drawings, there are provided rails mounted on a main body of the apparatus and a movable base or platform adapted to be brought into alignment with the rails under the guidance of a plurality of wheels. It should here be mentioned that the phrase "main body" does not designate a recording apparatus itself but an integral structure provided between the recording apparatus and a plurality of sheet receiving means—i.e. the bins—and including means for receiving the sheets discharged from the recording apparatus, the transporting belts and the movable platform for mounting thereon the discharge roller means. Of course, the movable platform may alternatively be guided by a wedge-like groove or other guide means. Further, any particular guide means may be spared in the event the lift means is constituted by a screw and nut feeding mechanism or by a rack and pinion combination.

The following description of the preferred embodiment of the invention will be made on the assumption that the vertical feed or lift apparatus is composed of a cord and sheave mechanism. However, it should be appreciated that the cord and sheave mechanism may be replaced by any suitable vertical feed or lift mechanism such as a feed screw and nut mechanism, a rack and pinion mechanism or a sprocket and chain combination, each of which has been previously known by itself. Further, the transporting belts may be constituted by a plurality of paired flat belts arranged in series.

The means for maintaining the individual transporting belts under tension between the drive means therefor and the roller means described above so as to prevent any possible slip relative to the roller means may be constituted by a single or several tension arm and roller means, provided that the distance swept by the movable base or platform is relatively short.

According to another aspect of the invention, there is proposed, particularly in view of the second object of the invention, a sheet sorting apparatus which comprises sheet introducing means disposed at a fixed position to receive the sheets as discharged from an image recording apparatus, for example, discharging means disposed at a distance from the introducing means and adapted to be movable in a vertical direction, transporting means provided between the introducing means and the discharge means, a main body adapted to be removably attached to the image recording apparatus, a bin assembly composed of a plurality of bins having respective openings arrayed along and directed toward the moving direction of the discharge means, and mounting means composed of openings provided in a main body of the recording apparatus at the sheet discharge side thereof as well as hooks provided on the aforementioned main body, or joint pins provided on the main body and hooks provided on the bin assembly.

With such arrangement, an advantage is obtained in that the sheet sorting apparatus can be used in place of a conventional discharge sheet collecting tray of a hitherto known copying machine or printer. In other words, the sheet sorting apparatus of the structure described above may be prepared as an attachment for conventional general purpose copying machines for enabling the copied sheets to be arrayed in proper order corresponding to the normal page sequence. Further, by virtue of the above described arrangement of the sorting apparatus, any jamming possibly occurring within the apparatus may be easily cleared by dismounting the sorting apparatus from the associated copying machine.

The above and other objects, novel features and advantages of the invention will be made more apparent in the following description of the preferred embodiment taken in conjunction with the accompanying drawings.

DETAILED DESCRIPTION OF THE PREFERRED EMBODIMENT

In the following description, it is assumed that the sheet sorting apparatus according to the invention is combined with an electrophotographic copying apparatus, although the invention is not intended to be restricted thereto but can be applied to various image or pattern recording apparatus such as other type copying machines, printers, facsimiles or other electrostatic recording machines.

Figure 1:
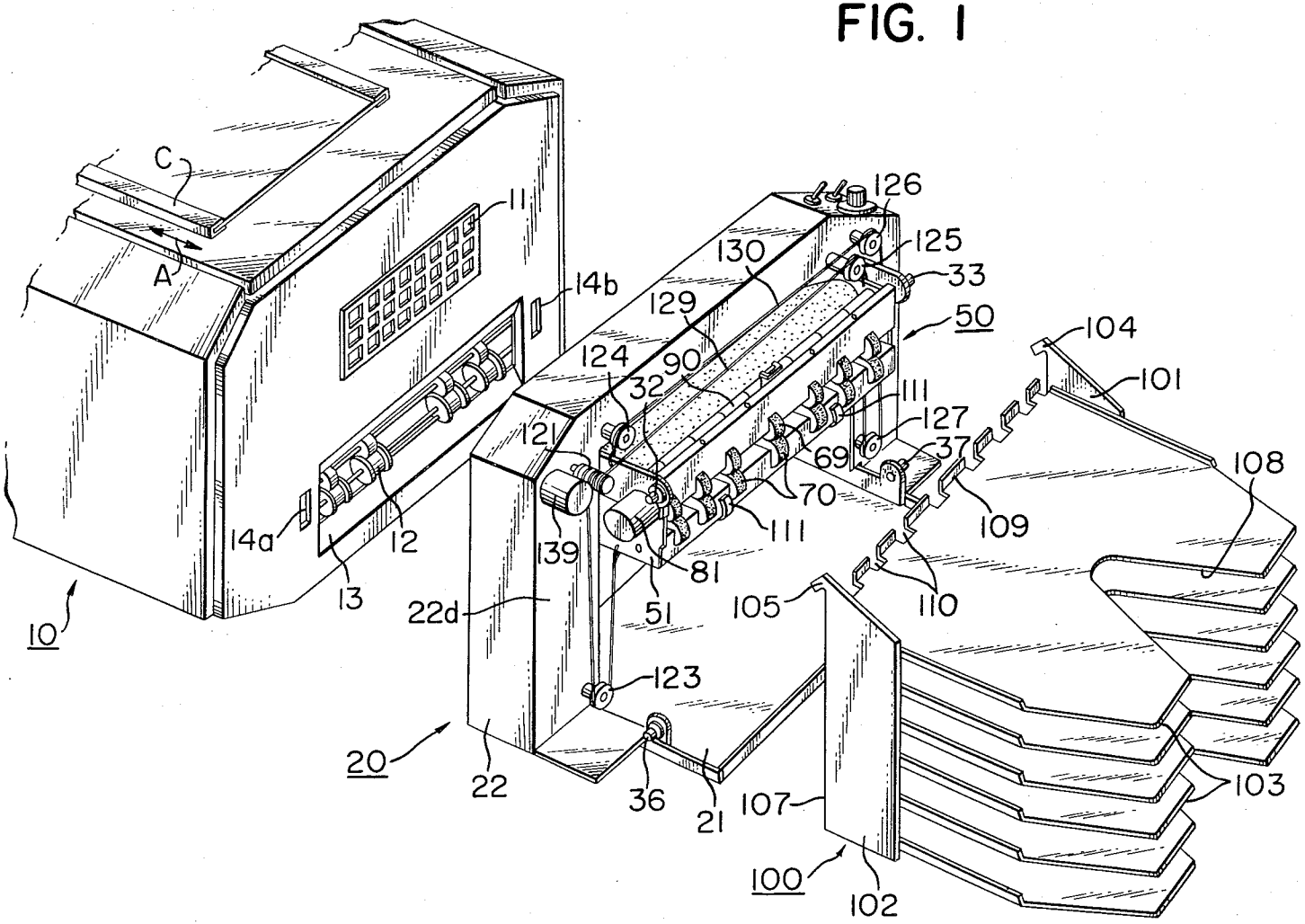
FIG. 1 is an exploded perspective view to illustrate the combination of a copying machine with a sheet sorting apparatus according to the present invention.

Now referring to FIG. 1, the sheet sorting apparatus according to an embodiment of the invention comprises a main body 20 adapted to be mounted on a copying machine 10 having a copy board or original carriage C operatively movable toward and away from the sheet discharge side of machine 10 as shown by double-headed reference arrow A in FIG. 1, a movable platform 50 supported for movement in the vertical direction relative to the main body 20, and a receiving tray or bin assembly 100 removably attached to the main body 20 at a rear side thereof. The copying machine 10 illustrated in FIG. 1 may be constituted typically by the one commercially available under the trade name "U-BIX V" from Konishiroku Photo-industrial Co., Ltd. of Japan. The copying machine 10 is provided at a rear side thereof with ventilation port 11 for dissipating exteriorly heat generated in the machine and a sheet discharge port 13 at which a plurality of sheet discharge rollers 12 are disposed for discharging the copied sheets. It will be noted that a pair of apertures **14*a* and 14*b* are formed at both sides of the discharge port 13 for receiving therein hooks 25*a*, 25*b* of the main body 20 (see FIGS. 2, 4 and 5**).

When the sorting apparatus is mounted on the copying machine by interengagement of hooks **25*a*, 25*b* with apertures 14*a*, 14*b*, all of the frame parts and operating elements of the sorter are so disposed as to project upwardly no higher than the topmost surface of the frame or body of copying machine 10 on which copy board C is movably supported. This is quite evident from FIGS. 1, 4 and 5, from which it is equally apparent that the whole of bin assembly 100 lies below this level. As a consequence, the running or moving path of copy board C during operative movement in the direction indicated by reference arrow A and its subsequent return movement carries copy board C over the whole of the sorting apparatus including bin assembly 100 and the endless belts 67, 68** which transport machine discharged copy sheets as fully disclosed hereinafter.

Referring to FIGS. 2 to 5, the main body 20 includes a hollow frame 22 formed integrally with a bottom plate 21 which has an outer dimension conforming to the size of the rear side of the copying machine 10. As can best be seen from FIG. 2, the frame 22 has a front wall **22*a* which is formed with an exhaust window 23 in alignment with the ventilation port 11 as well as a sheet inlet port (i.e. sheet introducing portion) 24 located in opposition to the sheet discharge port 13. The exhaust window 23 is defined by a bent portion of the front wall 22*a* so that ventilation may exert no adverse influences to the sheets distributed onto the individual bins. A pair of projections formed in the inner walls 22***b* and 22*c* of the frame 22 extend into the sheet inlet port 24 at both sides thereof and are provided with a pair of hooks 25*a* and 25*b* adapted to be inserted into the apertures 14*a* and 14*b*, respectively. In this manner, by inserting these hooks 25*a* and 25*b* into the associated apertures or openings 14*a* and 14*b*, the main body 20 can be attached to the copying machine 10.

Figure 6:
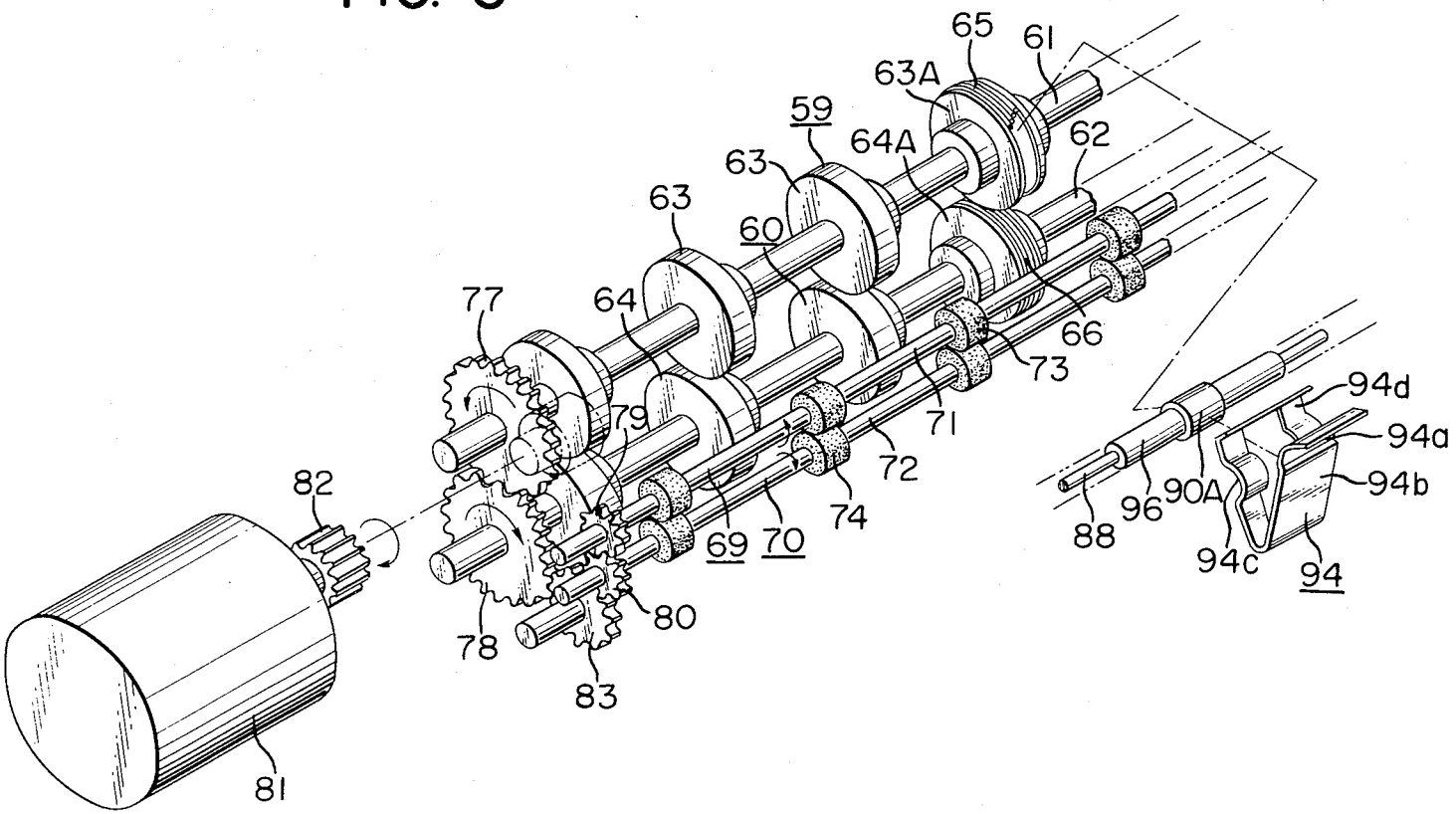
FIG. 6 is an enlarged exploded perspective view illustrating a structure of a drive unit for the movable platform.

There is disposed in the interior of the sheet inlet port 24 a pair of follower roller assemblies 26 and 27 in opposition to each other in a vertical direction. These roller assemblies are herein sometimes referred to as the sheet introducing means or sheet introducing roller means, although the sheet is actually received by means of belts described hereinafter. The follower roller assemblies 26 and 27 are, respectively, composed of shafts 26*a* and 27*a* each of which is rotatably supported by the inner walls 22*b* and 22*c* at both ends thereof and a plurality of individual disk-like follower rollers 26*b* and 27*b* (for example, as shown in FIG. 6) which are, respectively, mounted on the associated shafts 26*a* and 27*a* adjacent to one another in the axial direction (see, FIGS. 2 and 3). All of the rollers inclusive of driving rollers 63 and 64 described hereinafter are realized in an identical structure in consideration of the interchangeability among the rollers. Further, one of the disk-like follower rollers of each roller assembly is fixedly mounted on the associated shaft so as to be positioned at a center portion of a transporting belt.

The frame 22 includes a vertical rear wall 22*d* disposed in parallel to the front wall 22*a* and having legs of an inverted U-like configuration, which legs constitute guide rails 28 and 29 for the movable platform 50, as will be described hereinafter. The inner side walls 22*b* and 22*c* have respective joint members 30 and 31 which are formed at upper portions of the inner walls 22*b* and 22*c*, respectively, in opposition to each other in a lateral or transverse direction and extend rearwardly through the rear wall 22*d*. It goes without saying that the joint members are fixedly mounted to the main body 20. Joint pins 32 and 33 are fixedly secured to the joint members 30 and 31, respectively, at free ends thereof, and adapted to be engaged by hooks of the receiving bin assembly 100 constituted by a plurality of bins, as will be described hereinafter. Further, both the inner side walls 22*b* and 22*c* are provided at lower portions thereof with extensions 34 and 35, respectively, which extend rearwardly and have respective free ends at which pins 36 and 37 are, respectively, secured fixedly in opposition to each other as viewed in a horizontal direction. These pins 36 and 37 are adapted to engage the front side of the frame of the sheet receiving bin assembly 100 at a lower portion thereof thereby to assure a predetermined positional relationship between the main body 20 and the sheet receiving bin assembly 100. In other words, these pins serve to position the bin assembly 100 so that the openings of the individual bins are arrayed in a substantially vertical direction in parallel with the moving direction of the movable platform 50.

The movable platform 50 which is supported for movement upwardly and downwardly (i.e. in a substantially vertical direction) relative to the main body 20 has a geometrical center at a position opposite to the sheet inlet port 24 as viewed in the horizontal direction and includes a frame constituted by a pair of end plates 51 and 52 positioned in opposition to each other in the lateral or transverse direction and angle members 53 and 54 for connecting the end plates 51 and 52 to each other. Each of the end plates 51 and 52 is rotatably supported by a spacer 55 shown in FIG. 3 which serves to support a pair of wheels 56 disposed so as to hold each of the guide rails 28 and 29 in a sandwiched manner. Thus, the movable platform 50 can be smoothly moved upwardly and downwardly along the rear wall 22*d* of the main body 20 through rolling contact of the wheels 56 along the guide rails 28, 29. Upper and lower limit switches 57 and 58 (FIG. 4 and 5) are disposed within the main body 20 to detect the position of the movable platform 50, whereby a range through which the platform 50 is movable is determined by the limit switches 57 and 58 as will be described in detail in conjunction with the description on operation of the apparatus.

The movable platform 50 includes further a pair of drive roller assemblies 59 and 60 having drive shafts 61 and 62, respectively, which are rotatably supported at both ends by the end plates 51 and 52. Each of the drive roller assemblies 59 and 60 comprises a plurality of individual drive rollers 63 and 64 arranged adjacent to each other in the axial direction of the respective drive shafts 61 and 62. As is shown in FIG. 6, with a view to reliably transmitting the drive force to the transporting belt described hereinafter, the outer diameter of the center drive rollers 63A and 64A is selected slightly greater than that of the other drive rollers 63 and 64 so that the centering action is automatically exerted to the transporting belt. It will be seen that each of the center drive rollers 63A and 64A is formed with a peripheral groove which is filled with a friction material or medium constituted by a plurality of O-rings 65 and 66 so that these rollers 63A and 64A exhibit a greater frictional coefficient as compared with the other drive rollers 63 and 64. It should, however, be noted that the drive roller arrangement including the rollers 63, 64, 63A and 64A having the prescribed outer diameters as well as the O-rings 65 and 66 may be replaced by a pair of drum-like rollers having a center portion of a diameter greater than at both end portions. In the latter case, a frictional material can be employed in a peripheral portion of the drum-like roller in order to locally increase the frictional force.

Endless transporting belts 67 and 68 of a relatively large width are spanned, respectively, between the drive roller assembly 63 and the follower roller assembly 26 and between the drive roller assembly 64 and the follower roller assembly 27. These transporting belts should be combined with the various rollers described above so that proper transmission of the drive or transporting force can be assured. Further, the length of the transporting belt is selected as sufficiently long to span the maximum distance attained between the discharge roller assembly and the sheet introducing roller assembly when the former is moved furthest away from the latter. According to the teaching of the invention, drive portions or sheet holding portions 67*a* and 68*a* of the transporting belts 67 and 68 moving from the follower roller assembly 26 or 27 toward the drive roller assembly 63 or 64 are brought into intimate contact with each other to assure a smooth transportation of the sheet. Thus, a sheet X introduced through the sheet inlet port 24 is held in a sandwiched manner between the driving belt portions 67*a* and 68*a* and transported as the transporting belts 67 and 68 are moved in the directions indicated by arrows A and B.

The movable platform 50 includes a pair of displacing roller assemblies 69 and 70 disposed, respectively, adjacent to the drive roller assemblies 59 and 60 at the downstream side thereof. These displacing roller assemblies 69 and 70 include respective support shafts 71 and 72 mounted rotatably on the end plates 51 and 52 and sets of individual displacing rollers 73 and 74 fixedly mounted on the respective supporting shafts 71 and 72 and positioned in rolling contact with each other. These displacing rollers are intended to serve in transferring the sheets fed from the discharge roller assemblies 63 and 64 through the transporting belts to the predetermined bins without fail. It should be noted that the displacing rollers are not necessarily required for carrying out the invention. Secured fixedly to the rear side of the movable platform 50 are a pair of guide plates 75 and 76 at respective base portions thereof, while free ends 75*a* and 76*a* of these guide plates 75 and 76 are bent toward the interior of the platform 50 at intermediate locations between the individual displacing rollers 73 and 74. The sheet X to be transferred to the movable platform 50 through the transporting belts 67 and 68 is introduced between the free end portions 75*a* and 76*a* and then discharged to an aligned bin of the sheet receiving bin assembly 100 under the action of the displacing rollers 73 and 74.

FIG. 6 shows in detail a structure of the drive unit for the drive roller assemblies 59 and 60 as well as the displacing roller assemblies 69 and 70. Secured fixedly on one end of each of the drive shafts 61 and 62 are gears 77 and 78 of a relatively large diameter which are meshed and driven in synchronism with each other. On the other hand, gears 79 and 80 of a relatively small diameter are, respectively, mounted fixedly on one end of the supporting shafts 71 and 72 and are meshed with each other to be driven in synchronism. A drive motor 81 is fixedly mounted on the end plate 51 and has an output shaft on which a pinion 82 is secured and adapted to be meshed with the gear 77. In this connection, it is preferred to arrange the motor drive circuit such that the motor speed is increased as the load is reduced, thereby to prevent looseness or sagging of the sheet sandwiching portions of the transporting belts which would otherwise occur when the follower roller assemblies 26 and 27 are moved toward the discharge roller assemblies 63 and 64. An intermediate gear 83 rotatably supported by the end plate 51 is simultaneously meshed with both gears 78 and 80. With the arrangement of the gear trains described just above, the supporting shafts 71 and 72 are caused to rotate at a higher speed than the drive shafts 61 and 62.

According to the teaching of the invention, means is provided which serves to maintain the drive portions 67*a* and 68*a* of the transporting belts 67 and 68 in a tensioned state to a certain degree independently from any vertical position of the movable platform 50, thereby to prevent the occurrence of slippage between the transporting belts 67, 68 and the drive roller assemblies 59, 60 and/or the follower roller assemblies 26, 27. In principle, the transporting belts 67 and 68 should be so supported that at least the drive portions 67*a* and 68*a* thereof are tensioned to a certain degree, while the other belt portions may be held with or without relaxation. However, in general, the arrangement in which the belt portions except for the drive portions 67*a* and 68*a* are held with relaxation will allow the range of movement of the platform 50 to be increased, whereby the number of bins of the sheet receiving bin assembly can be correspondingly increased. To this end, the invention teaches that a single or plural tension rollers supported by a tension arm(s) be incorporated in the main body 20 and/or the movable platform particularly where the number of bins is restricted and a limitation is imposed to the range along which the platform 50 is movable.

Figure 2:
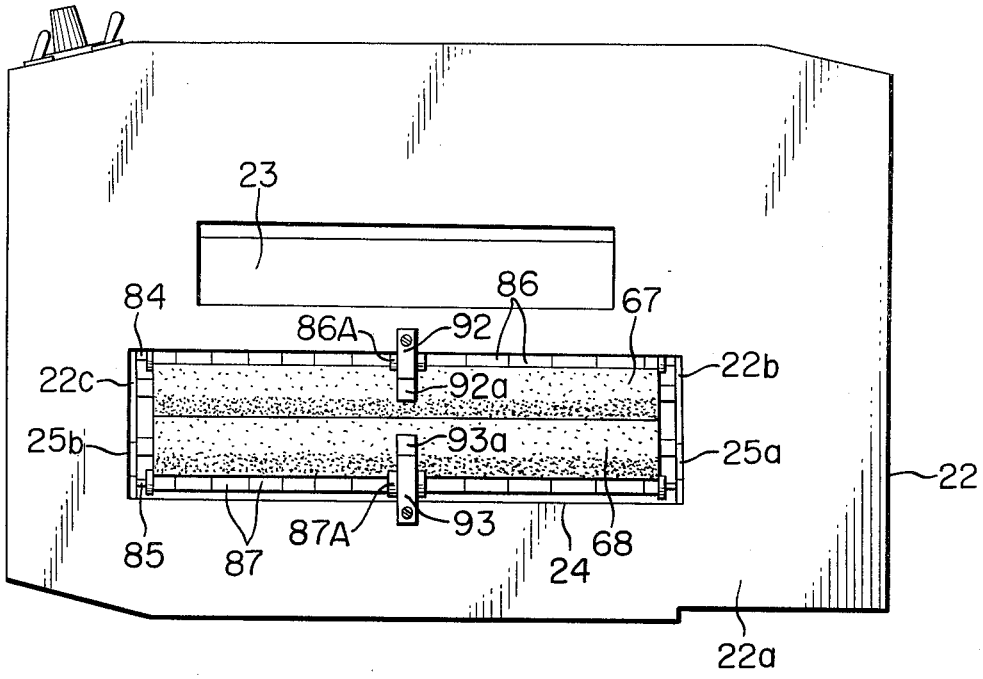
FIG. 2 is a front view showing a sheet sorting apparatus according to an embodiment of the invention.
Figure 3:
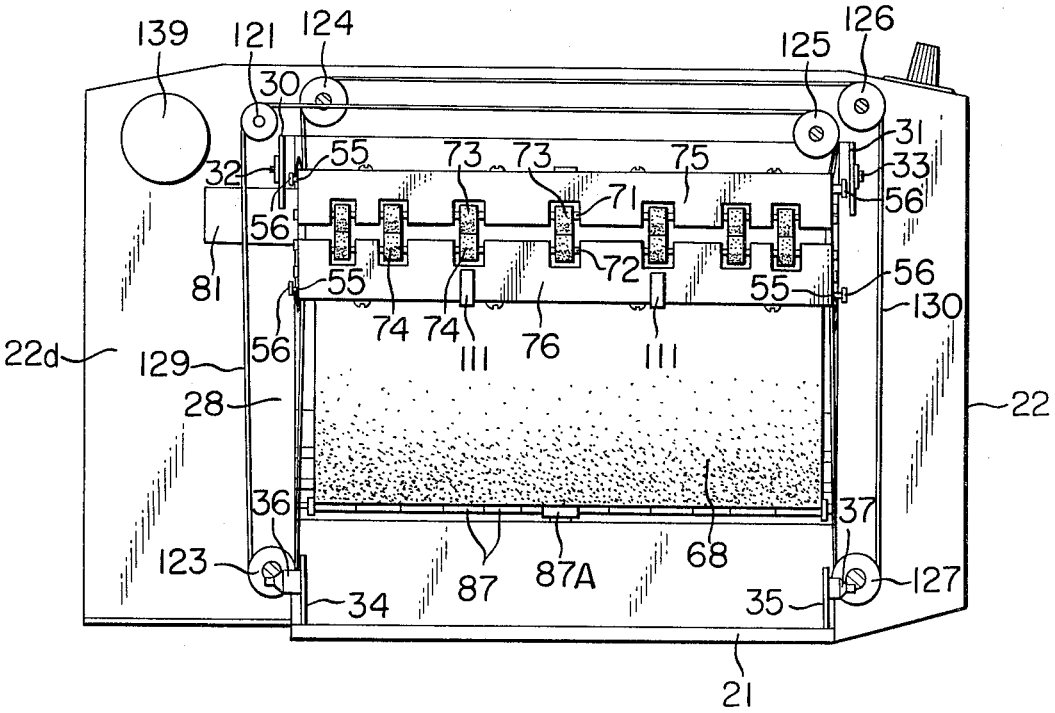
FIG. 3 is a rear view showing the same with a sheet receiving tray or bin assembly removed.

An example of structure appropriate for the purpose described above is shown in FIGS. 2, 4 and 5. Referring to these figures, the structure comprises supporting rods 84 and 85 positioned adjacent to the peripheral surfaces of the follower roller assemblies 26 and 27 at a side opposite to the drive portions 67*a* and 68*a* and supported at both ends by the inner walls 22*b* and 22*c*, a number of sleeves 86 and 87 supported idly rotatably on the supporting rods 84 and 85 for pressing the transporting belts 67 and 68 against the corresponding follower roller assemblies 26 and 27 or for preventing the relaxation of the belts at these points, second supporting rods 88 and 89 disposed adjacent to the peripheral surfaces of the drive rollers 63 and 64 at a side opposite to the drive portions 67*a* and 68*a* and supported at both ends by the end plates 51 and 52, and a second group of sleeves 90 and 91 supported idly rotatably on the supporting rods 88 and 89 for pressing the transporting belts 67 and 68 against the corresponding drive rollers 63 and 64 or for preventing the relaxation of the belts at these points. As will be appreciated from the description above, the sleeves may be located at a small distance, for example of 1 mm, from the surface of the respective transporting belts. These sleeves should preferably be mounted for movement in the axial direction of the respective supporting rods so as to follow the possible lateral movement of the transporting belts. Additionally, the center sleeves 86A, 87A and 90A which hold the belts in a sandwiched manner in cooperation with the center drive rollers and follower rollers have an outer diameter greater than that of the other sleeves, as is shown in FIGS. 2 and 6, in order to prevent slippage from occurring at intermediate portions of the transporting belts 67 and 68 as viewed in the transverse direction thereof due to flexing of the supporting rods 84, 85 and 88. To the same effect, the outer surfaces of the transporting belts 67 and 68 may be roughened so as to exhibit a higher friction coefficient than the inner surfaces.

Figure 4:
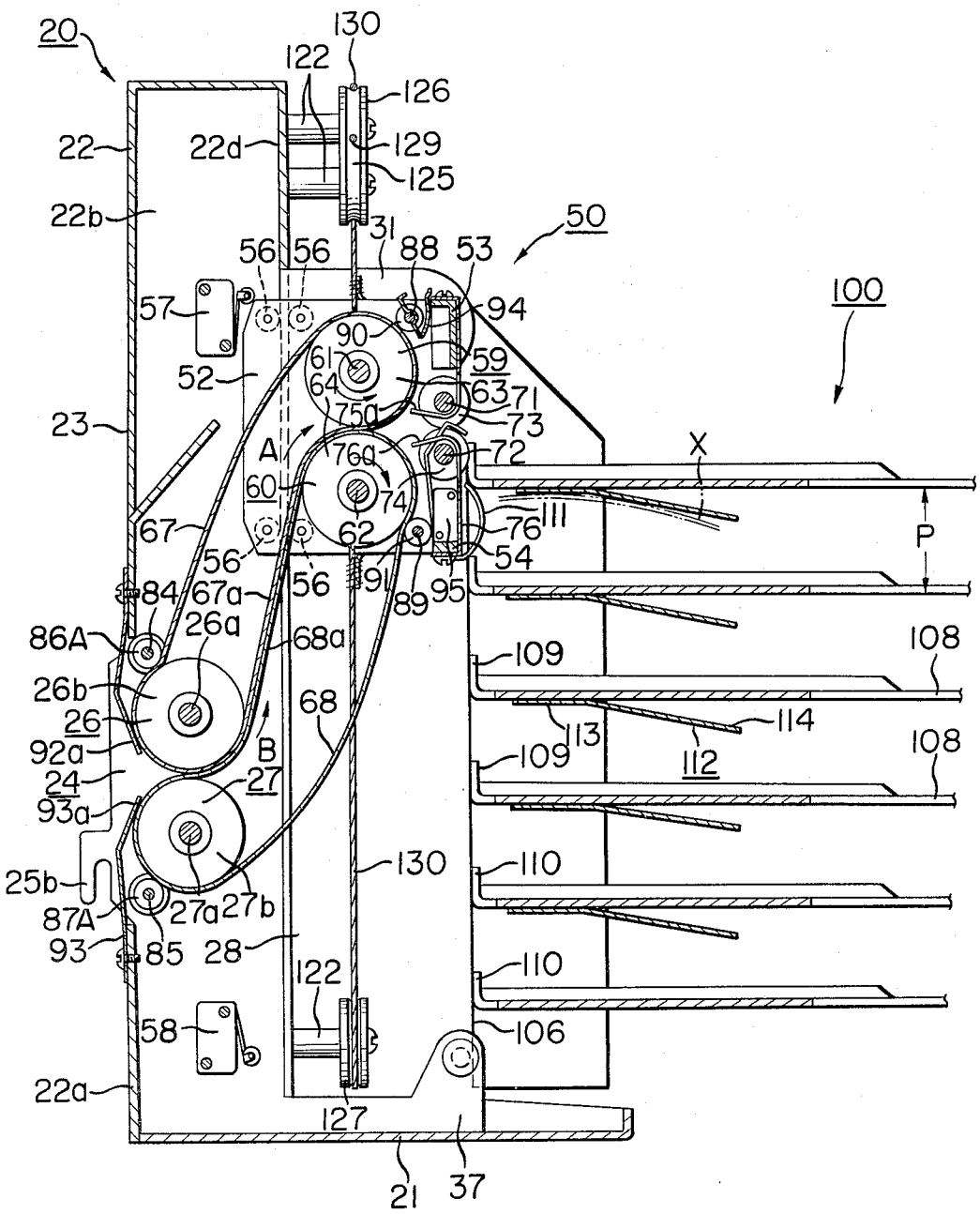
FIG. 4 is an enlarged sectional side view of the same.
Figure 5:
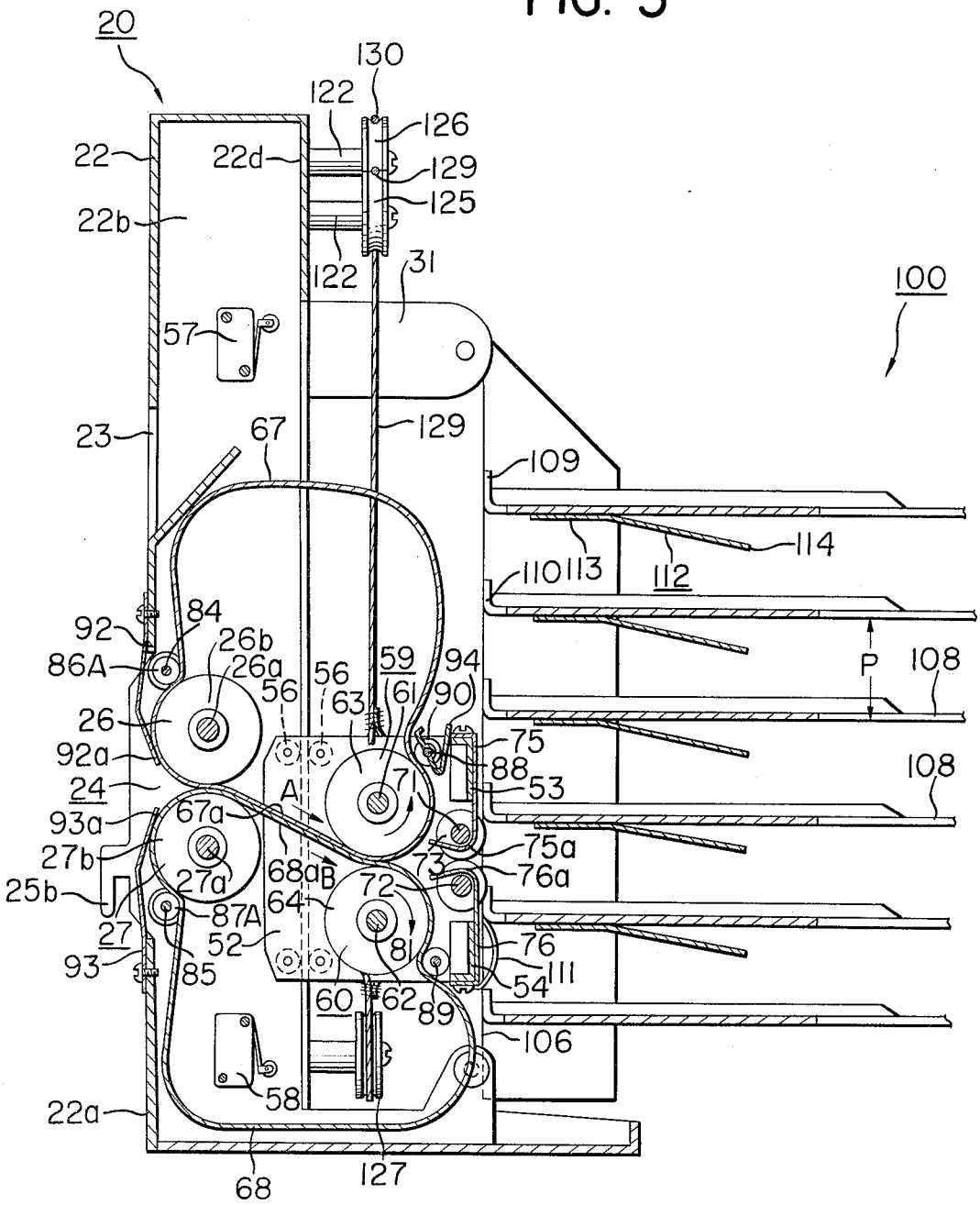
FIG. 5 is a view similar to FIG. 4 and showing the sheet sorting apparatus in a state in which a movable platform is at a lowered position.

In the case of the illustrated embodiment, means is provided for preventing relaxation of the drive portions 67*a* and 68*a* due to the idle rotation of the follower rollers 26 and 27 as well as the occurrence of jammed sheets due to slippage between the transporting belt 67 and the drive roller assembly 63. More specifically, and referring to FIG. 2, a pair of leaf springs 92 and 93 positioned vertically opposed to each other are secured to the outer front wall 22*a* of the main body 20 with the free ends of the springs being inserted into the sheet inlet port 24, while the base portions of the springs are fixedly secured to the front wall 22*a* by means of screws. The free end portions 92*a* and 93*a* of these leaf springs 92 and 93 positioned at a transversely mid portion of the sheet inlet port 24 are caused to resiliently and slidably bear on the surfaces of the transporting belts 67 and 68 wound around the follower roller assemblies 26 and 27. In this manner, these leaf springs 92 and 93 serve to apply a tension of a proper magnitude to the drive portions 67*a* and 68*a* of the transporting belts 67 and 68. Further, the sleeve 90 is disposed in contact against the surface of the transporting belt 67 under the influence of V-like spring 94, as is illustrated in FIG. 6 on an enlarged scale. The V-like spring 94 is composed of a leg portion 94*b* having a recess 94*a* at which the spring 94 is engaged by the angle member 53 of the movable platform 50 and another leg portion 94*d* having a groove 94*c* to be engaged by the sleeve 90. Thus, the spring 94 interposed between the angle member 53 and the sleeve 90 will cause the supporting rod 88 to be resiliently deformed or flexed thereby to make the sleeve 90 to bear on the surface of the transporting belt 67. As a result, the pressure which the conveyor or transporting belt 67 bears on the drive roller assembly 63 is increased, involving a correspondingly increased frictional force to prevent slippage from occurring between the drive roller assembly 63 and the transporting belt 67. In FIG. 4, reference numeral 95 denotes a micro-switch for sensing the discharge of the sheet X. More specifically, when the trailing edge of a sheet X has passed by the micro-switch, the latter produces a signal for advancing the movable platform by a predetermined distance to a position at which the sheet can be discharged into the succeeding bin. Description in more detail will be made in conjunction with the control circuit.

The bin assembly 100 comprises a pair of side plates 101 and 102 positioned in opposition to each other in the transverse direction. Disposed stationarily between the side plates 101 and 102 is a vertical array of plural bins 103 with a constant pitch or inter-bin spacing P, each of the bins 103 being orientated horizontally. The side plates 101 and 102 are formed integrally with hooks 104 and 105 at the upper front edges, respectively. These hooks 104 and 105 are adapted to rest on the joint pins 32 and 33 of the main body 20, respectively. On the other hand, front stopper surfaces 106 and 107 formed in the side plates 101 and 102 at a lower portion thereof bear against the stopper pins 36 and 37.

In each of the bins 103, a notch 108 is formed at a rear end portion thereof to facilitate the discharge of the sheet X resting on the bin. In addition, each of bins 103 has a front edge 109 bent in the vertical direction for positioning positively the rear edge of the sheet X at a proper position. Further, a plurality of recesses 110 are formed in the front end portion 109 of the bin 103 for receiving therein the displacing rollers 73 and 74 projecting from the movable platform 50. By virtue of the presence of these recesses 110, the rear edge of the sheet X can be extracted to a position beyond the front edge 109 of the bin 103. Reference numeral 111 denotes a plurality of arcuate springs which can be provided at the rear side of the movable platform 50, as occasion requires. With such arrangement, these springs projecting deeply into the associated recesses 110 will cause the rear end portion of the sheet X to drop onto the bin 103, as the movable platform 50 is moved in the vertical direction.

It should be mentioned that, in the case of the illustrated bin assembly 100, there may arise a possibility that a sheet X resting on the bin 103 will float and a succeeding sheet will be inserted under the floating sheet, to disorder the page sequence. With a view to avoiding such an undesireable phenomenon, all of the bins 103 except for the lowermost bin are provided at the bottom with respective deflecting plates 112 each made of a leaf spring. Each of these deflecting plates 112 extending in the longitudinal direction is secured at the base or front end portion thereof to the bottom surface of the associated bin 103, with the rear end portion 114 of the plate 112 being inclined downwardly. Thus, the front or leading edge of the sheet X being inserted into the bin 103 is deflected toward the bottom surface of the bin under the guiding action of the deflecting plate 112, whereby the undesirable phenomenon described above can be positively excluded.

According to another aspect of the invention, there is provided lift means for vertically moving the movable platform 50 relative to the main body 20. Such lift means may be constituted by conventional mechanisms such as a rack and pinion assembly, a chain and sprocket combination, a feed screw and nut combination, a wire and sheave assembly, or the like which is disposed between the main body 20 and the movable platform and adapted to index the positions of the movable platform 50.

In the case of the illustrated embodiment, the lift means generally designated by numeral 120 is assumed to be constituted by a wire (cord) and sheave combination, by way of example. More specifically, the lift means comprises a drive pulley shaft 121, and five sheaves 123, 124, 125, 126 and 127 (refer to FIG. 3) rotatably supported on spacers 122 which in turn are mounted on the rear wall 22*d*. Further, the lift means 120 includes a first wire or cord 129 having one end secured to the movable platform 50 at one end thereof. The wire 129 extends around the sheave 125, through a spiral groove 128 formed in the drive puller shaft 121 (FIG. 7) and thence around the sheave 123. The other end of the wire 129 is secured to the other end of the movable platform 50. Additionally, a second wire 130 is provided which has one end secured to the movable platform 50 at one end thereof and extends around the sheaves 124, 126 and 127. The other end of the second wire 130 is also secured to the movable platform at the other end.

Figure 7:
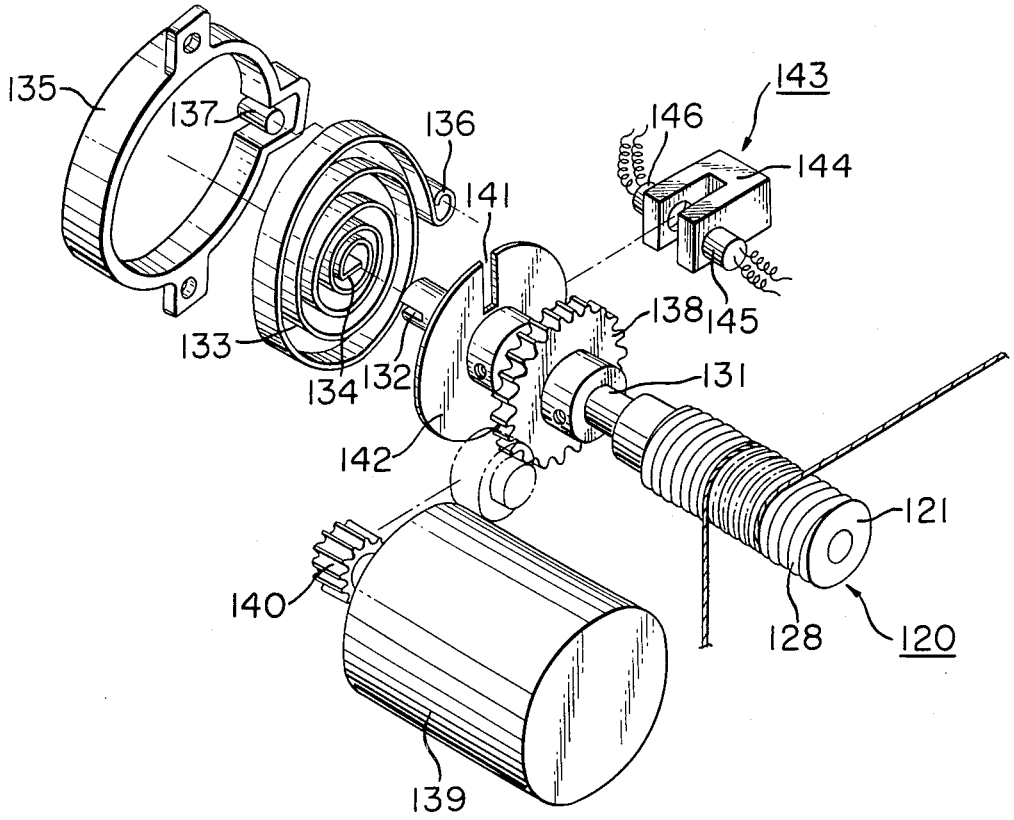
FIG. 7 is an enlarged exploded perspective view showing a main portion of a lift apparatus.

FIG. 7 shows a drive unit for the lift means 120. The drive pulley shaft 121 described above is fixedly mounted on a control shaft 131 at one end portion thereof, the control shaft 131 in turn being rotatably supported by the frame 22 of the main body 20. A groove 132 is formed in the control shaft 131 at the other end portion thereof and receives therein an inner end portion 134 of a bias spring 133 carrying the weight of the movable platform 50. The spring 133 is accommodated within a holding cap 135 secured to the frame 22. The outer end portion 136 of the bias spring 133 is secured to an inner wall of the holding cap 135 by a pin 137 anchored thereto.

The control shaft 131 carries a spur gear 138 of a relatively large diameter which meshes with a pinion 140 mounted fixedly on the output shaft of a reversible motor 139. Further, a disk 142 having slits 141 formed therein with a predetermined pitch corresponding to that of the bin array 103 is mounted fixedly on the control shaft 131. Although only a single slit is shown in FIG. 7, it will be appreciated that a predetermined number of the slits 141 are formed in the disc 142. A photoelectric detector array 143 is provided in straddled relation across the disc 142 to detect the passage of the slits 141 to thereby producing a pulse signal representative of the rotation angle of the drive pulley shaft in a manner well known in the art. The photoelectric detector array 143 is mounted on a U-like holding member 44 which in turn is fixedly secured to the frame 22. It will be readily seen that the photoelectric array 143 includes a light emission diode 145 and a phototransistor 146 disposed in opposition to each other with a peripheral edge portion of the disc 142 being interposed therebetween. The output signal from the photoelectric detector array 143 is utilized together with the output signal from the micro-switch 95 serving to detect the discharge of the sheet X to control the reversible motor 139. The control operation for the motor 139 as well as the drive motor 81 will be described in detail by referring to FIGS. 8 to 13 showing an electric control circuit.

Figure 8:
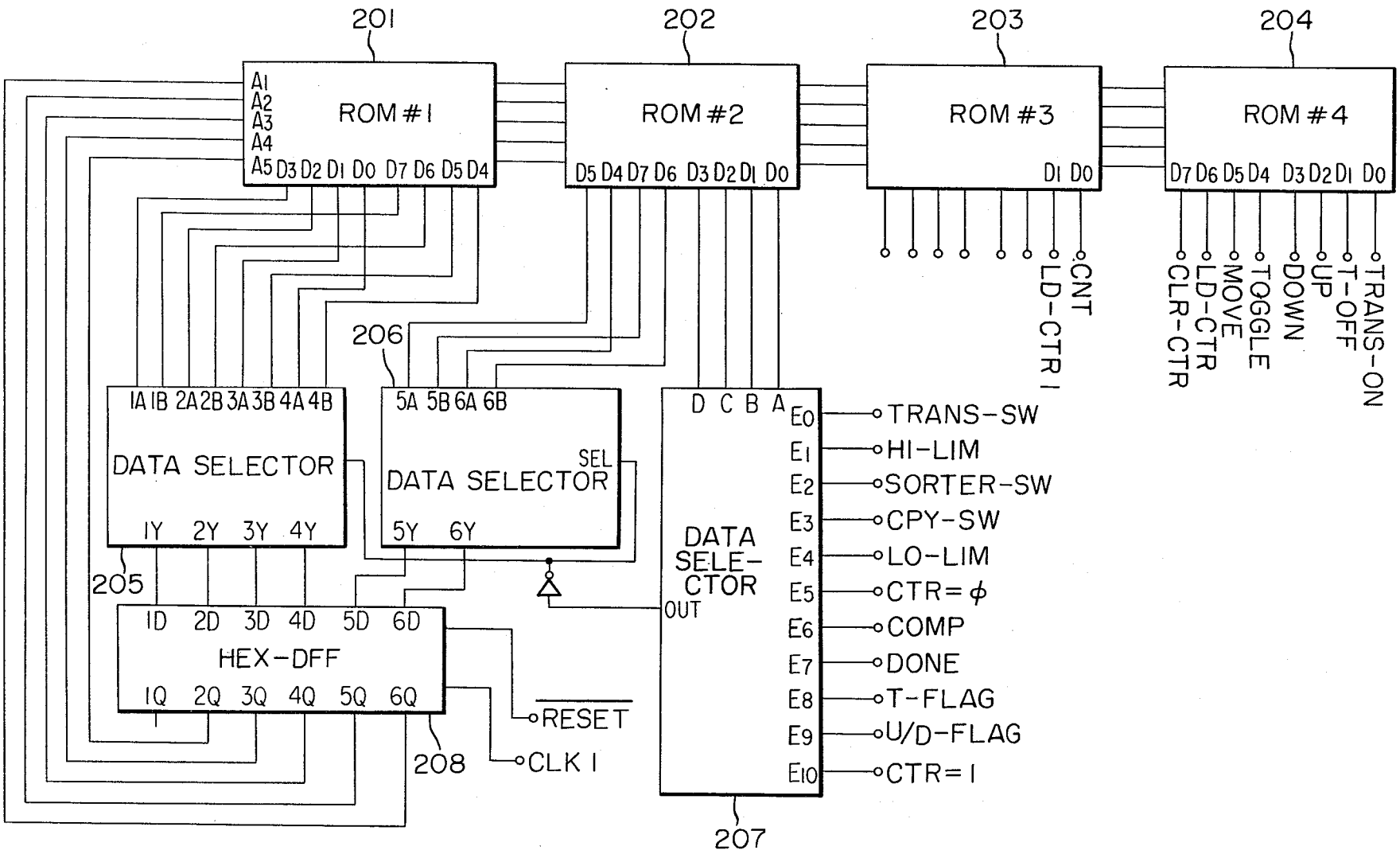
FIG. 8 is a circuit diagram of a controller of a control unit employed according to the invention.

Referring to FIG. 8 which shows a circuit arrangement of a controller constituting a central part of the control circuit, there are provided read-only memories or ROM's 201, 202, 203 and 204 each of a 32 byte capacity, 2T01 type data selectors 205 and 206, a 11T01 type data selector 207, and a flip-flop circuit 208 including six D-flip-flops. Instructions stored in ROM's 201 to 204 are read out in dependence on the input state of the data selector 207, whereby control commands for the drive motor 81 and the reversible motor 139 are output.

Figure 9:
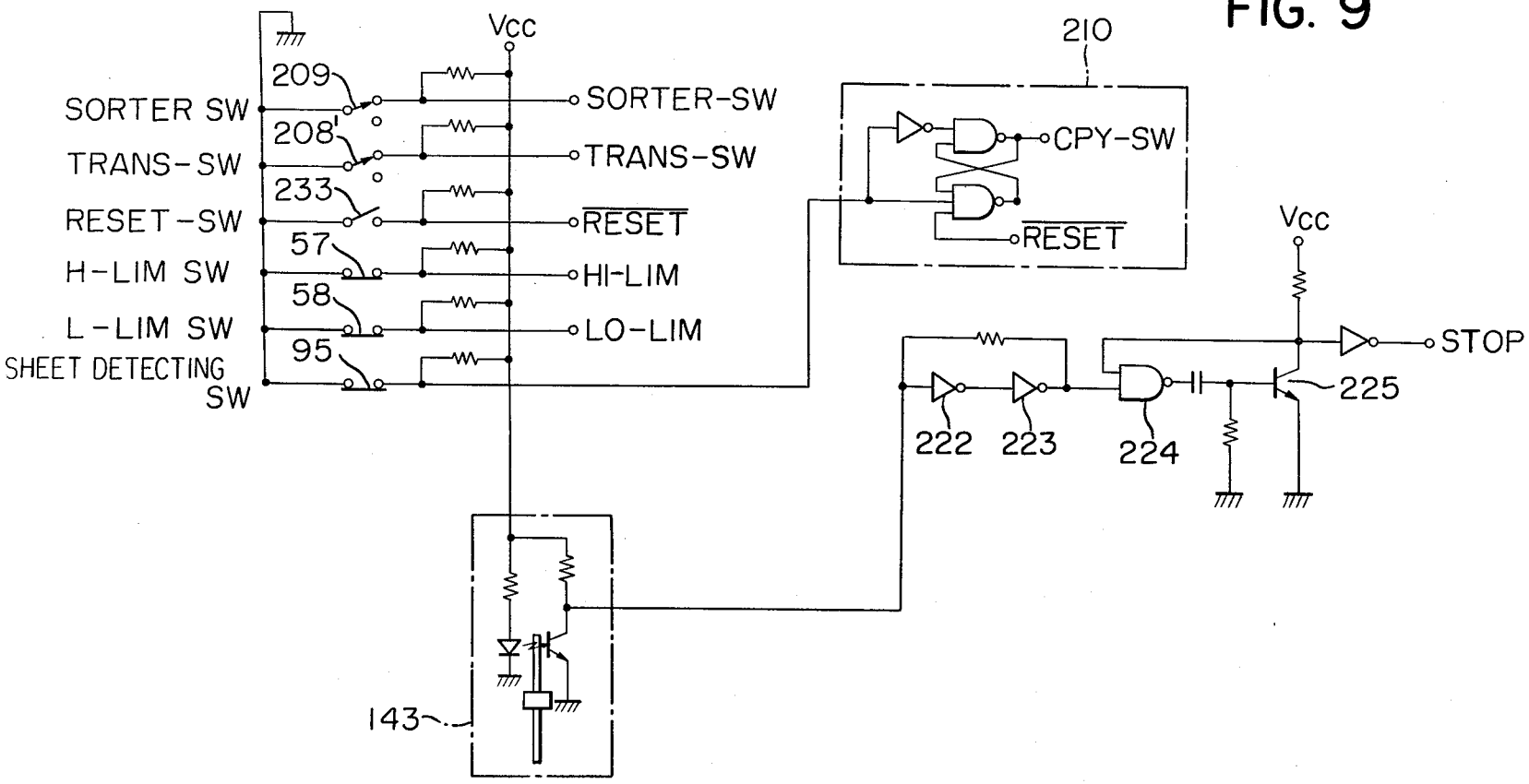
FIG. 9 is a circuit diagram of a command circuit of the control apparatus.

Among the input signals to the data selector 207, the signals TRANS-SW, HI-LIM, SORTOR-SW, LO-LIM and CPY-SW which are also shown in FIG. 9 are output signals from various switches. The signal TRANS-SW is a drive command signal for the drive motor 81 to designate the closing of the switch 208' (FIG. 9). The signal SORTER-SW represents the turn-on of a command switch 209 (FIG. 9) for commanding whether or not sheet sorting should be effected. The signal LO-LIM and HI-LIM represent the "ON" state of the micro-switches 57 and 58 described hereinbefore. Among the other input signals to the data selector 207, the signal CPY-SW indicates detection of the presence of the sheet X through the discharge sensing switch 95 and is derived from the switch 95 through a chatter suppressing circuit 210. The other signals CTR="0", COMP, DONE, T-FLAG, U/D-FLAG and CTR="1" will be described by referring to FIGS. 10 and 11.

Among the command outputs from the ROM's 203 and 204, a signal TRANS-ON represents a command for operating the drive motor 81, a signal TRANS-OFF commands the termination of operation, a signal UP commands the upward movement of the movable platform 50, a signal DOWN commands the downward movement of the platform 50, a signal TOGGLE commands the changing-over of the platform 50 from the up-movement to the down-movement or vice versa, and a signal MOVE commands operation of the reversible motor 139. The set of these command signals is supplied to a motor control circuit shown in FIG. 10. The other remaining signals LD-CTR, CLR-CTR, CNT and LD-CTR1 will be described hereinafter by referring to FIG. 11.

Figure 11:
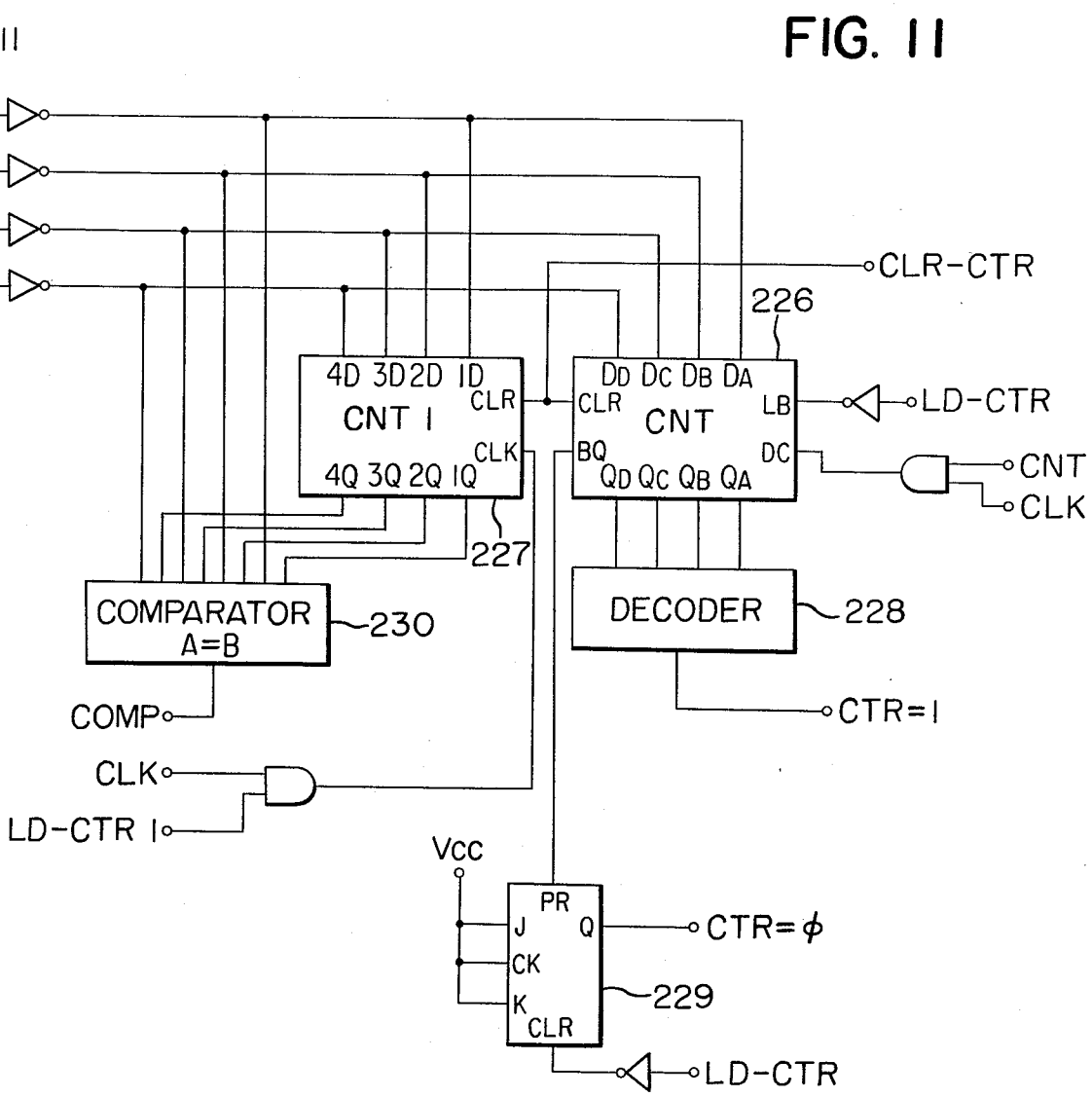
FIG. 11 is a circuit diagram showing a counter configuration of the control unit.

FIG. 11 shows a circuit of a counter for obtaining binary coded information about the number of sheets preset by a switch 211 for setting the number of sheets to be sorted and the information about the instant position of the movable platform 50.

Figure 12:
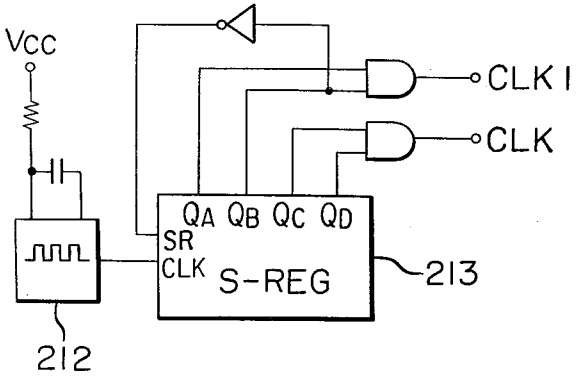
FIG. 12 is a circuit diagram showing a clock generator circuit.

FIG. 12 is a circuit diagram of a clock signal generator for producing clock signals required for controlling the timing in synchronous operations among the various units. The output pulse signal from the pulse generator 212 is applied to a shift register 213 as a shift input signal, whereby two-phase clock signals CLK1 and CLK2 are derived from the output of the shift register 213.

Figure 13:
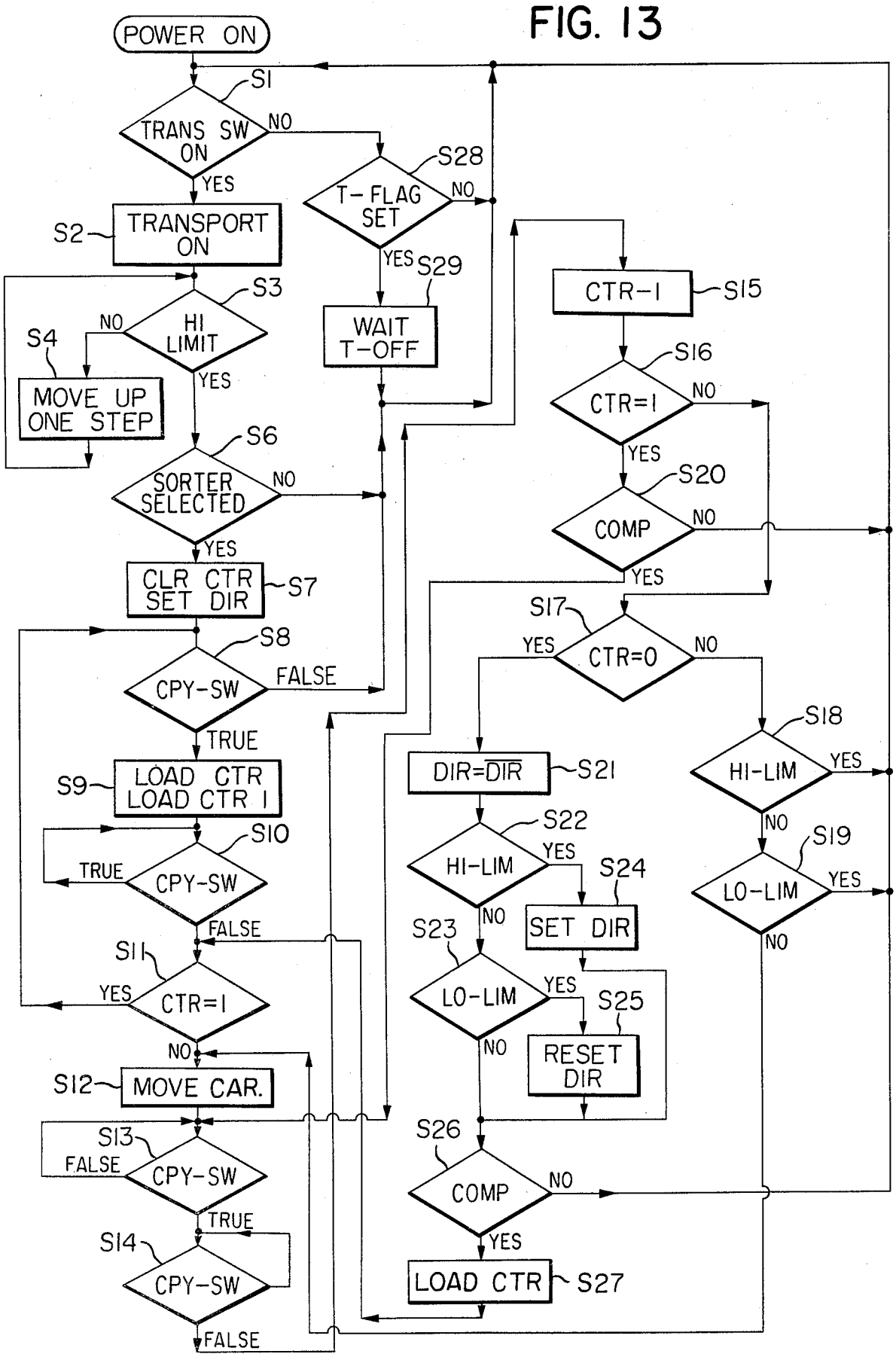
FIG. 13 is a flow chart to illustrate operations of the control unit.

In the following, control operations will be described with the aid of a flow chart shown in FIG. 13.

Figure 10:
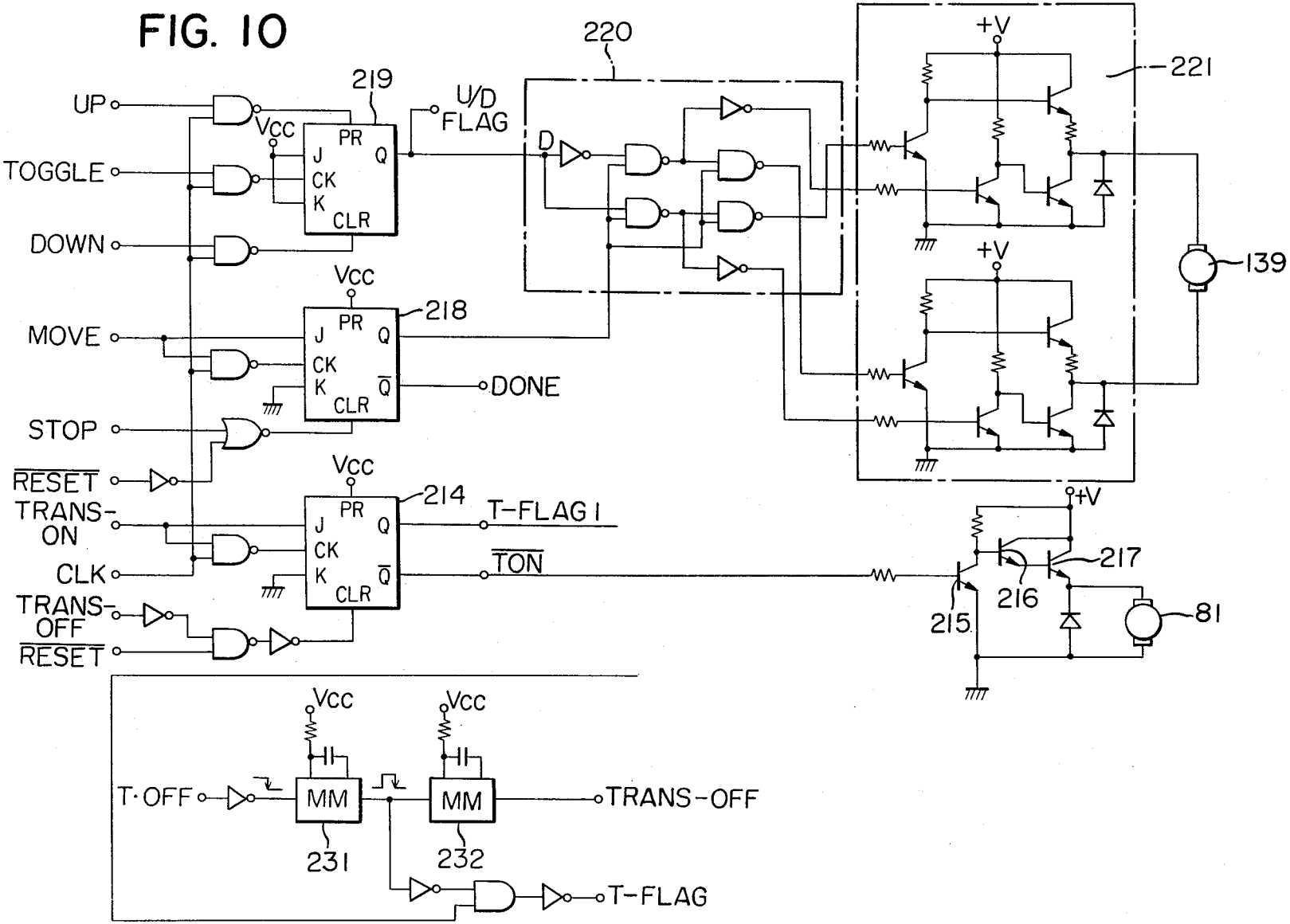
FIG. 10 is a circuit diagram showing a motor control circuit of the control unit.

Upon turn-on operation of the switch 208 for the drive motor (step 1), the signal TRANS-SW is selected by the data selector 207 shown in FIG. 8, while the data selectors 205 and 206 will read out from the memories 201 and 202 instructions stored in the flip-flop circuit 208 under the timing of the clock signal CLK1. The instructions as read out are utilized as the address of the memories 201 to 202 to obtain the instruction TRANS-ON from the memory 204. A flip-flop 214 shown in FIG. 10 is set by the instruction TRANS-ON under the timing of the clock CLK. The output $\overline{Q}$ from the flip-flop 214 will then turn off a transistor 215, whereby a Darlington circuit of transistors 216 and 217 is turned on to initiate the operation of the drive motor (step S2).

Next, a decision is made from the signal HI-LIM as to whether or not the movable platform 50 is at the uppermost position (step S3). If the answer is negative, commands UP and MOVE are output from the memory 204. A flip-flop 218 shown in FIG. 10 is set by the signal MOVE, while a flip-flop 219 is preset by the signal UP. Consequently, the up-down flag U/D FLAG takes the state "UP", resulting in the reversible motor 139 being rotated in the direction to move the platform 50 in the upward direction (step S4). When the platform 50 has moved upwardly by one pitch or level of the bin assembly, the flip-flop 218 is reset by one-shot pulse signal STOP (FIG. 9) produced from the photoelectric detector array 143, whereby the motor 139 is once stopped and started again in dependence on the decision made at the step S3. When the signal HI-LIM becomes logic "0" in the course of repeating the above routine, it is determined that the upward movement of the platform 50 has been completed. Then, the program proceeds to the next step S6. For producing the signal STOP in the circuit shown in FIG. 9, inverters 222 and 223 are used as amplifiers while NAND gate 224 and a transistor 225 function as a mono-stable multivibrator.

When the platform 50 has attained the uppermost position, it is decided on the basis of the signal from the switch 209 whether the sheet sorting is to be effected. When the signal SORTER-SW=0, the step S1 is regained, whereby the drive motor 81 is driven continuously with the platform 50 being placed at the uppermost position. If the switch 209 is turned on, the instructions CLR-CTR and DOWN are output from the memory 204, as the result of which the four-circuit D-flip-flop CNT1 is cleared. At the same time, the flip-flop 219 shown in FIG. 10 is reset to prepare for restating the reversible control motor 130 to lower the platform (step S7).

Under these conditions, a decision is made as to whether the first copied sheet has been discharged to the location of the discharge sensing switch 95 (step S8). When the leading edge of the copied sheet X touches the switch 95 (TRUE), the latter is turned off, giving rise to the occurrence of the signal CPY-SW of logic "1". The program then proceeds to the next step S9, at which the commands LD-CTR and LD-CTR1 are output from the memories 203 and 204, whereby the set number of sheets as set by the switch 211 is preset to the counter 226 and flip-flop 227 shown in FIG. 11. Subsequently, when it is determined at the step S10 from the signal CPY-SW that the trailing edge of the copied sheet X has passed by the switch 95 (FALSE), the output from the decoder 228 for decoding the contents in the counter 226 is checked to determine whether the set value of the sheet number setting switch 222 is equal to one (CRT=1) at the step S11. If the signal CTR=1 is logic "1", this means that the value set by the sheet number setting switch 211 is equal to one. The program is then returned to the step S8 to detect the succeeding sheet X. Through repetition of the above routine, a so-called single sheet copying operation is carried out with the platform 50 being located at the uppermost position.

When the signal CTR=1 is logic "0" at the step S11, meaning that two or more sheets are set by the sheet number setting switch 211, then the command MOVE is output from the memory 204 to set the flip-flop 218 thereby to lower the platform 50 by one pitch or level of the bin assembly, because one sheet X has been already discharged to the uppermost bin (step S12). The downward movement of the platform is stopped by resetting the flip-flop 218 by the signal STOP. Upon lowering of the platform 50 by one step through the processing at the step S12, the succeeding sheet X is awaited at the next step S13.

When the leading edge of the copied sheet X is detected at the step S13 and subsequently the leading edge of the sheet X is detected at the step S14, the command CNT is output from the memory 203, because the sheet has been discharged also to the second bin. In response to the command CNT, a single-shot pulse of the signal CLK is applied to the terminal DOWN-COUNT of the counter 226, whereby 1 (one) is subtracted from the contents of the counter 226 (step S15).

At the next step S16, it is determined on the basis of the signal CTR=1 whether the contents of the counter 226 is equal to 1 as in the case of the step S11. If the answer is negative, this means that the number of sheets as set at the switch 211 is more than three. Consequently, the decision at the step S17 as to whether the contents of the counter 226 is equal to zero or not will result in the negative. Then, the flip-flop 229 is preset by the signal BORROW-OUT produced from the counter 226, whereby the logic state "1" or "0" of the Q output signal CTR=0 from the flip-flop is determined by the control unit (FIG. 8).

As the program proceeds to the steps S18 and S19 from the step 17, a check is made to ascertain that the platform 50 is positioned at neither the upper limit nor at the lower limit position. Thereafter, the program is returned to the step S12, at which the movable platform 50 is moved upwardly or downwardly by one pitch or level of the bin assembly. However, since the platform is set for downward movement at the step S7, the platform will be positioned to the third bin as counted from the uppermost one.

In succession to the step S12, it is determined that the sheet is received by the third bin through the steps S13 and S14. Thereafter, the contents of the counter 226 are decremented by one unit at the step S15. A similar decision is made at the step S16. In this manner, when the number of sheets set at the switch 211 is more than three, the program proceeds through the steps S12-S13-S14-S15-S16-S17-S18-S19 and returns again to the step S12 to lower the platform 50 by one pitch, while the contents of the counter 226 are decremented by one unit. Accordingly, when the number of sheets as set is represented by N, the platform is lowered step-by-step (N−1) times, whereupon the signal CTR−1 becomes logic "1" as determined at the step S17. When the set number is equal to 2, a single step-down of the platform 50 causes the contents of the counter 227 to be equal to 1.

The contents of the counter 227 being equal to 1 means that the platform has been lowered to the final position corresponding to the number of sheets as set and that the first sorting cycle has been completed. Then, a decision is made as to whether the second sorting cycle is to be repeated for the same number of sheets X at the step S20. More particularly, a new set value at the sheet number setting switch 211 is compared with the value stored in the flip-flop 227 through a comparator 230. When a coincidence signal COMP is produced from the comparison, the program will proceed to the step S12 to initiate the second sorting cycle. On the other hand, when no coincidence is found, the step S1 is regained, thereby to prepare another sorting operation with a different number of sheets.

The second sorting operation is started from the final position of the platform 50 in the upward direction. Through the steps S13 and S14, the copied sheet X is discharged to the bottom bin, and the contents of the counter 226 are decremented by one unit, to thereby reset the counter 226. Thus, the program proceeds to the step S21 through the steps S16 and S17.

At the step S21, a command TOGGLE is output from the memory 204 to control the upward movement of the platform 50, while the flip-flop 219 is changed over to the reset state, to prepare for the upward movement of the platform. Subsequently, it is decided whether the platform is at the upper or lower limit position at the steps S22 and S23 in a manner similar to that at the steps S18 and S19. When the platform is at the upper limit position, a command DOWN is output from the memory 204 at the step S24 to reset the flip-flop 219. On the other hand, upon detection of the lower limit position of the platform, the command UP is output from the memory 204 at the step S25 to set the flip-flop 219. These steps S22 to S25 serve to prevent erroneous operation of the platform 50.

At the step S26, the value set at the sheet number counter 211 is compared with the contents of the D-flip-flop 227 in a manner similar to that at the step S20. The result of the execution of the step S26 is utilized for determining whether the second or further sorting operations are to be continued.

Upon appearance of the coincidence output COMP="1" at the step S26, the command LD-CTR is output from the memory 204 at the step S27 and the set number of sheets X is stored again at the counter 226. Subsequently, upward movement of the platform 50 by one step is carried out at the step S12 in succession to the step S11. Then, the steps S13-S14-S15-S16-S17-S18-S19-S12 are repeated. When the contents of the counter 226 becomes equal to 1, indicating that the platform 50 has been returned to the uppermost position, a copied sheet X is discharged to the uppermost bin at the succeeding sorting cycle through the steps S20-S13-S14-S15. The platform 50 is then controlled for the downward movement.

Finally, when the switch 208 is restored to terminate the sorting operation the program proceeds to the step S28 from the step S1. In the meantime, it is determined whether the flip-flop 214 is in the set state; i.e. whether the drive motor 81 is in operation or not from the state of the signal T-FLAG. In case the motor 81 is in operation, a command T-OFF is output from the memory 204 and converted to the signal TRANS-OFF with a delay (e.g. 5 seconds) brought about by a cascade connection of mono-stable multivibrators 231 and 232. The delayed signal TRANS-OFF is utilized as the clear signal for the flip-flop 214 which is then reset to stop the operation of the drive motor 81. The timer control for stopping the operation with a delay is executed at the step S29.

In FIGS. 8 to 11, the signal RESET serves to manually stop the motors 81 and 139 and for initializing the control or command unit. This signal is produced from a reset switch 233 which is scarcely operated in normal operation.

What is claimed is:

1. A sheet sorting apparatus in which sheets discharged from a pattern recording apparatus are received by sheet introducing means and, after having been transported through transporting means to discharge means provided on a movable platform arranged movably in a substantially vertical direction to a main body of the sorting apparatus, distributed sequentially to a plurality of bins having inlet openings arrayed along a vertical moving path of said discharge means, characterized in that:

said sheet introducing and discharge means are spaced relatively apart by a distance that varies between a minimum and a maximum-defined distance as the platform moves vertically along said vertical path thereof for distributing sheets to selected ones of said plural bins, said transporting means is constituted by a pair of superposed endless belts spanning said introducing and discharge means for holding the sheet in a sandwiched manner therebetween, the length of said endless belts being sufficient to span said maximum distance between said discharge and introducing means, and means on the sheet sorting apparatus for maintaining the superposed portions of the sandwiched belts between which sheets are transported in a tensioned state between said introducing and discharge means as said distance varies during vertical movement of the platform.

2. An apparatus as set forth in claim 1, wherein said sheet introducing means and said discharge means comprises respective shafts and a plurality of disk-like rollers mounted on said shafts, one of the rollers at least being positioned at center portion to the belts, substantially.

3. An apparatus as set forth in claim 2, wherein said discharge means is substantially coupled to an electric motor mounted on said movable platform and serve as a drive medium to transmit a drive power to said transporting belts.

4. An apparatus as set forth in claim 2, wherein the rollers mounted on at least one of the shafts at a center portion with relation to the belts has a greater frictional force to said transporting belts than the other rollers.

5. An apparatus as set forth in claim 2, wherein a roller mounted on at least one of the shafts at a center portion with relation to the belts has a larger diameter than the other rollers.

6. An apparatus as set forth in claim 2, wherein the surface of a roller mounted on at least one of the shafts at a center portion with relation to the belts exhibits a higher frictional coefficient than that of the other rollers.

7. An apparatus as set forth in claim 1, wherein said movable platform including said discharge means is adapted to be moved by a wire and sheave assembly provided between the main body and said movable platform.

8. An apparatus as set forth in claim 7, wherein said wire and sheave assembly includes a drive pulley shaft for driving a wire and a force accumulating spring for carrying the weight of said movable platform.

9. An apparatus as set forth in claim 1, wherein the vertical path of said discharge means extends over and below the level of said sheet introducing means.

10. An apparatus as set forth in claim 1, wherein a pair of displacing rollers are provided with the movable platform at a downstream side of said discharge means.

11. A sheet sorting apparatus, comprising sheet introducing means mounted at a fixed position and adapted to receive sheets discharged from a pattern recording apparatus, discharge means provided vertically movably spaced from said introducing means by an amount which varies with vertical movement of said discharge means, transporting means provided between said sheet introducing means and said discharge means, a main body adapted to be removably attached to the pattern recording apparatus, and a bin assembly mounted removably on said main body and including a plurality of bins having respective openings arrayed along the moving direction of said discharge means, said transporting means including a pair of superposed endless belts spanning said introducing and discharging means for transporting sheets between said endless belts and means for maintaining the superposed portions of the belts between which sheets are transported in a tensioned state continuously as said spacing between the introducing and discharge means varies with vertical movement of said discharge means.

12. An apparatus as set forth in claim 11, wherein moving means for mounting removably said main body onto said pattern recording apparatus includes latch openings provided at a sheet discharge side of said pattern recording apparatus, and hooks provided at said main body in correspondence to said openings, while means for mounting said bin assembly onto said main body includes joint pins provided at said main body and hooks provided at said bin assembly and adapted to be disengageably latched by said joint pins.

13. A sheet sorting apparatus for use in combination with an electrophotographic copying machine in which a copy board for carrying an original to be copied is so arranged as to project toward a sheet discharge side of the copying machine, said apparatus comprising a pair of sheet introducing roller means provided at a fixed position to receive sheets discharged from the copying machine, a pair of discharge roller means disposed vertically movably and spaced from said roller means by a distance that varies as said discharge roller means is vertically moved, a main body disposed between said sheet introducing roller means and said discharge roller means and including a pair of endless belts of a length sufficient to span said discharge roller means and said introducing roller means when the former is spaced at its furthest distance from the latter, said belts being disposed so that at least a portion of each said belt is disposed in superposed relation to the other of said belts and in a continuously tensioned state as the distance between said introducing and discharge roller means varies, and so that the top surface of said belts lies under a running path of the copy board, and a bin assembly including a plurality of bins having inlet openings arrayed along the moving direction of said discharge roller means, said bin assembly being located so that the top portion thereof is positioned below the running path of the copy board.

14. An apparatus as set forth in claim 13, wherein said bin assembly is removably mounted on said main body.

15. An apparatus as set forth in claim 13, wherein said main body is adapted to be removably mounted on said copying machine.

16. An apparatus as set forth in claim 13, wherein said main body is removably attached to said copying machine, while said bin assembly is removably mounted on said main body.

* * * * *